US008167024B2

(12) United States Patent
Kunstreich

(10) Patent No.: US 8,167,024 B2
(45) Date of Patent: May 1, 2012

(54) METHOD AND ASSOCIATED ELECTROMAGNETIC APPARATUS FOR ROTATING MOLTEN METAL IN A SLABS CONTINUOUS CASTING INGOT MOULD

(75) Inventor: Siebo Kunstreich, Saint Ouen (FR)

(73) Assignee: ROTELEC, Bagnolet (FR)

( * ) Notice: Subject to any disclaimer, the term of this patent is extended or adjusted under 35 U.S.C. 154(b) by 30 days.

(21) Appl. No.: 12/808,313

(22) PCT Filed: Dec. 17, 2007

(86) PCT No.: PCT/FR2007/002104

§ 371 (c)(1),
(2), (4) Date: Jun. 15, 2010

(87) PCT Pub. No.: WO2009/077661

PCT Pub. Date: Jun. 25, 2009

(65) Prior Publication Data

US 2010/0263822 A1 Oct. 21, 2010

(51) Int. Cl.
*B22D 11/115* (2006.01)

(52) U.S. Cl. ..... 164/468; 164/504

(58) Field of Classification Search ..... 164/468, 164/504

See application file for complete search history.

(56) References Cited

U.S. PATENT DOCUMENTS 5,746,268 A 5/1998 Fujisaki et al.

FOREIGN PATENT DOCUMENTS

EP 0 750 958 1/1997

*Primary Examiner* — Kuang Lin

(74) *Attorney, Agent, or Firm* — Oblon, Spivak, McClelland, Maier & Neustadt, L.L.P

(57) ABSTRACT

Four distinct polyphased inductors for a travelling magnetic field and mounted with two inductors per large side on the large sides of the ingot mold, the inductors placed side by side on a same large side of the ingot mold and producing driving forces that push the molten metal, along the width of the ingot mold, both in the same direction, which is a direction opposite to that of the driving forces produced by the two inductors placed opposite on the other large side.

2 Claims, 2 Drawing Sheets

METHOD AND ASSOCIATED ELECTROMAGNETIC APPARATUS FOR ROTATING MOLTEN METAL IN A SLABS CONTINUOUS CASTING INGOT MOULD

CROSS-REFERENCE TO RELATED APPLICATIONS

This application is based upon and claims priority under 35 U.S.C. §371 from International Patent Application No. PCT/FR07/02104, filed Dec. 17, 2007.

BACKGROUND OF THE INVENTION

Field of the Invention

The present invention relates to the continuous casting of metal slabs, especially steel. It relates more particularly to the use of travelling magnetic fields in the ingot mould, which thereby confer on the cast liquid metal a rotational movement about the casting axis.

It is known that the continuous casting of steel slabs is conventionally carried out in a vertical or essentially vertical ingot mould that is made of two large sides (or walls) facing each other made of copper or copper alloy, vigorously cooled by circulating water, and of two small lateral sides that seal the ends of the large sides and thereby define a casting gap that will determine the size of the cast product. The molten metal is poured under gravity into this gap where it will progressively solidify on contact with the cooled metallic walls of the ingot mould while the solidified peripheral strand is removed from the bottom to complete its solidification in the secondary cooling stages of the casting machine. Thus, during the whole of the casting process, the molten metal fills the casting gap up to a certain height forming a meniscus (free surface of the liquid metal) covered by slag, and a constant flux of molten metal is continually brought into the ingot mould by means of a generally single submerged pouring spout (several tens of centimetres below the meniscus) and centred on the casting axis, and equipped with lateral outlets that open towards the narrow end sides.

The fundamentals of axial rotation of molten metal at the meniscus level in a continuous casting ingot mould for slabs by means of travelling magnetic fields have already been established and are well known. Schematically, the metal in its entirety is caused to rotate about the axis of casting in a unique oblong movement by means of the driving forces produced by the horizontally travelling magnetic fields generated by static polyphased inductors mounted on the large sides of the ingot mould.

For example, the document EP 0 151 648 proposes the use of four separate identical inductors mounted symmetrically on the large sides of the ingot mould, with two inductors on each large side, placed on either side of the spout, each inductor partially covering half the width of the large side on which they are mounted, between the spout and the narrow end sides. These three phase inductors each generate a horizontally travelling magnetic field, the direction of travel being the same for the two inductors on the same side and counter to those produced by the two inductors opposite on the other large side. Consequently, from the interaction between the magnetic field generated by any one inductor and the molten metal in the proximity of that inductor, there results a pushing force on the metal according to the width of the ingot mould. This interaction, repeated four times in the straight section of the ingot mould, i.e. once per inductor, creates a system having four entraining forces, of which two, located diagonally with respect to the casting axis, push the metal from the spout towards the narrow sides, therefore towards the "exterior", while the two other forces, opposite on the other diagonal, push the metal towards the "interior", from the narrow sides towards the spout.

In another example, the Japanese Patent application JP 57075268 retains the principle of one single partial inductor per large side. Each inductor, positioned diagonally to one another with respect to the casting axis, covers about ¾ of the large side on which it is mounted. Consequently, the remaining ¼ is left free of any action of the travelling field so as to allow the rotating current of metal to slow down before the frontal contact with the narrow side end at right angles thereby attenuating the energy of impact.

In the same vein, the European Patent 0 096 077 proposes equipment based on three in-line inductors per large side, jointly generating magnetic fields that travel horizontally in the same direction, but associated with means that enable them to produce differentiated pushing forces on the cast metal. Taken in the direction of the travelling field, the first inductor, near to a small side end, would therefore ensure the speeding up of the mass of molten metal opposite, the second would maintain the speed in the central part of the large side, and the third would be tuned to allow a deceleration of the flow of metal that passes in front of it before the frontal impact against the other small side end.

More recently, the European Patent 0 750 958 appears to go even further by proposing an equipment for circulating the metal at the meniscus, said equipment consisting of a single, integral inductor per large side, therefore of the type described in JP 57075268 mentioned above, but supplied by a complex circuit that connects it to its three phase power supply. This improvement in the electrical circuit, applied to an inductor of an old design, aims to enable the application, here as well, of means to modulate the driving force as a function of the width of the ingot mould. The object aimed for in this case is for the force to be greater in the region of the end of a large side so as to "push" the molten metal towards the exterior, than that acting in the same end region opposite on the other large side and facing in the opposite direction (therefore pushing towards the interior). Thus, disputing the preceding reflections on the wish to slow down the current of metal before the frontal impact against the small end sides, this way of operation would permit, according to this document, both a more uniform axial rotation of the metal at the meniscus and a more uniform metal temperature in contact with the wall of the ingot mould at this place. In fact, although this document is not explicit on this point, it would appear from our analysis that such an objective could only actually be achieved with the means described above, when the natural hydrodynamics of the metallic bath in the ingot mould has the "double roll" type of configuration.

We will discuss later the meaning of this term in regard to the description of the type of circulation of the molten metal inside the ingot mould, notably in contrast to the "single roll" type. For the time being, one can but conclude that if the proposals to solve the oblong axial rotation of the metal at the meniscus are so lengthy and have been in the literature for so many years, this is because an optimal solution has not yet been found. But, it is precisely because the present invention takes into account the primordial importance of the nature of the circulation of the molten metal inside the ingot mould that the invention is able to provide an optimal solution for ensuring at the meniscus a stable and homogeneous, oblong, axial rotational movement of the molten metal throughout, or essentially throughout the casting.

SUMMARY OF THE INVENTION

Accordingly, the first object of the invention is a process for imparting an electromagnetic axial oblong rotation of molten metal in a continuous casting ingot mould for slabs equipped with a submerged pouring spout centred on the casting axis and having lateral outlets that open towards the small end sides, process in which, at least four polyphased inductors for a magnetic field travelling along the width of the ingot mould are mounted with two inductors per large side on the large sides of said ingot mould, and said inductors placed side by side on a same large side of the ingot mould are adjusted to create a system with four driving forces, of which the two forces associated to any pair of inductors located diagonally to one another with respect to the casting axis push the metal from the spout towards the small sides, i.e. "towards the exterior", while the other two forces, associated to the other pair of inductors located diagonally to one another, push the metal from the small sides towards the spout, i.e. "towards the interior", the combined application of these four forces imparting an overall axial, oblong rotational movement to the metal at the meniscus, process, characterised in that, with the aim of homogenising said rotational movement of the molten metal at the meniscus during the casting, the intensities of said driving forces are adjusted, with respect to one another in a differentiated manner, such that in the proximity of a large side if there the flow of the metal is stronger "towards the interior" than "towards the exterior", then higher intensities are applied to the two forces that push the metal "towards the exterior", and conversely, if said flow is weaker "towards the interior" than "towards the exterior", then higher intensities are applied to the two forces that push the metal "towards the interior".

Natural flow of the metal is understood to mean the flow that develops as a function of the cited quadruplet without the inductors being switched on.

In a preferred embodiment, the intensities of the driving forces of each pair of inductors located diagonally to each other with respect to the casting axis are equalised between them.

In another preferred embodiment, the intensities of all the driving forces are equalised between them if and only if the nature of the natural flow of the bath of metal in the ingot mould is of the type "unstable flow".

In accordance with a first, principal variant of this process, in which the circulation of the molten metal at the meniscus is directly considered, the speed at the meniscus of the molten metal that is flowing "towards the interior" and of that flowing "towards the exterior" is measured in the proximity of the same large side of the ingot mould; a representative differential signal, both in amplitude and polarity, of the difference between said measured speeds is made up and the differentiation of said driving forces between forces pushing "towards the interior" and those pushing "towards the exterior" is adjusted by applying that continuously makes said differential signal tend to zero.

In accordance with a second, principal variant, in which the circulation of the molten metal at the meniscus is directly considered and predicted, the nature of the natural flow of the molten metal within the ingot mould is predicted by taking into account the parameters relating to the casting, then the driving forces are differentiated between themselves in order to further intensify the forces that push the metal "towards the interior" when the nature of the natural flow of the molten metal is of the "single roll" type, and conversely, in order to further intensify the forces that push the metal "towards the exterior" when the nature of the natural flow of the molten metal is of the "double roll" type.

Preferably, not only the nature of the natural flow is predicted, but also the natural speed of circulation of the metal at the meniscus, and the difference between the driving forces pushing "towards the exterior" and those pushing "towards the interior" is adjusted such that this difference is proportional to said predicted natural speed at the meniscus.

A further object of the invention is electromagnetic equipment for carrying out the first variant of the process in which the speed of circulation of the molten metal at the meniscus is measured in order to achieve an oblong rotation of the molten metal in the upper part of a continuous casting ingot mould for slabs equipped with a submerged pouring spout centred on the casting axis and having lateral outlets that open towards the small end sides of the ingot mould, equipment comprising at least four distinct polyphased inductors for a travelling magnetic field which are mounted with two inductors per large side on the large sides of said ingot mould, said inductors being placed side by side on a same large side of the ingot mould and producing between them driving forces that push the molten metal, depending on the width of the ingot mould, in the same direction and in an opposite direction from that of the driving forces produced by the two inductors placed opposite on the other large side, such that a four force-system is created, of which the two forces associated to any pair of inductors located diagonally to one another with respect to the casting axis push the metal from the spout towards the small sides, i.e. "towards the exterior", while the other two forces, associated to the other pair of diagonally located inductors, push the metal from the small sides towards the spout, i.e. "towards the interior", and comprising, with the aim of realising the homogeneous axially rotational movement at the meniscus:

- a unit for polyphased supply of the inductors with electric current and equipped with means for differentiating the driving forces of each inductor on the molten metal cast in the ingot mould;
- speed measurements means for measuring, in the proximity of the same large side of the ingot mould, the speeds at the meniscus of the molten metal that is flowing "towards the interior" and that which is flowing "towards the exterior" and to produce a differential signal representative in amplitude and in sign, of the difference between said measured speeds;
- and control means of said electric supply unit, which in response to said differential signal, are capable of acting on said means for differentiating the driving forces to make said differential signal tend towards zero.

Yet another object of the invention is electromagnetic equipment for carrying out the variant of the process in which the speed of circulation of the molten metal at the meniscus is predicted in order to achieve an axial, oblong rotation of a bath of molten metal in a continuous casting ingot mould for slabs equipped with a submerged pouring spout centred on the casting axis and having lateral outlets that open towards the small end sides of the ingot mould, equipment comprising at least four distinct polyphased inductors for a magnetic field travelling along the width of the ingot mould which are mounted with two inductors per large side on the large sides of said ingot mould, said inductors being placed side by side on a same large side of the ingot mould and producing between them driving forces that push the molten metal, depending on the width of the ingot mould, in the same direction and in an opposite direction from that of the driving forces produced by the two inductors placed opposite on the other large side, such that a four force-system is created, of which the two forces associated to any pair of inductors located diagonally with respect to the casting axis push the metal from the spout towards the small sides, i.e. "towards the exterior", while the other two forces, associated to the other pair of diagonally located inductors, push the metal from the small sides towards the spout, i.e. "towards the interior", equipment comprising, with the aim of realising the homogeneous axially rotational movement at the meniscus:

- a unit for polyphased supply of the inductors with electric current and equipped with means for differentiating the driving forces of each inductor on the molten metal cast in the ingot mould;
- means to identify the nature of the natural flow state of the bath of molten metal within the ingot mould;
- and control means of said electric supply unit, which in response identification means, are capable of acting on said means for differentiating the driving forces in such away as to further intensify the forces that push the metal "towards the interior" if the natural flow state of the bath of metal is of the "single loop" type, and conversely, in such a way as to further intensify the forces that push the metal "towards the exterior" if the natural flow state of the bath of metal is of the "double loop" type.

In a variant of a preferred embodiment, said means of control of the supply intervene in the means to differentiate the intensities of the driving forces in order to equalise the intensity of all the forces, if and only if the nature of the natural flow of the bath of metal is of the type "unstable flow".

In a completely automated variant of a preferred embodiment, the means of identifying the nature of the flow of the metallic bath within the ingot mould are predictive in nature and constituted by a computerised system comprising a computer programmed with random access memory (RAM) in which are saved identification tables (and/or their analytical form) constructed by means of a fluid mechanics mathematical model describing the natural flows derived from the casting parameters, viz. the argon flow, the cross section of the cast slab, the geometry and the immersion depth of the spout and the casting speed.

At this point it is convenient to recall the meanings of "single roll", "double roll" and "unstable flow" when discussing the possible configurations adopted by the natural hydrodynamics of a bath of metal within an ingot mould for slabs in the course of the casting. As will be understood, and in accordance with the fundamentals of the invention, it is in reality these configurations and only these that will shape the topology of the field of electromagnetic driving forces to be applied in the ingot mould in order to give the meniscus a homogeneous and well developed axial, oblong rotational movement. Likewise, it seems opportune to also define what is meant by homogeneous rotational movement, together with the benefits that are expected in regard to the quality of the cast metal.

BRIEF DESCRIPTION OF THE DRAWINGS

The invention and its means of implementation will be described in more detail below with reference to the annexed figures presented by way of example, and in which.

In the figures, the same elements are identified by identical references.

DETAILED DESCRIPTION OF THE INVENTION

Figures 1A, 1B, 2A, 2B, 3A, 3B, 4:
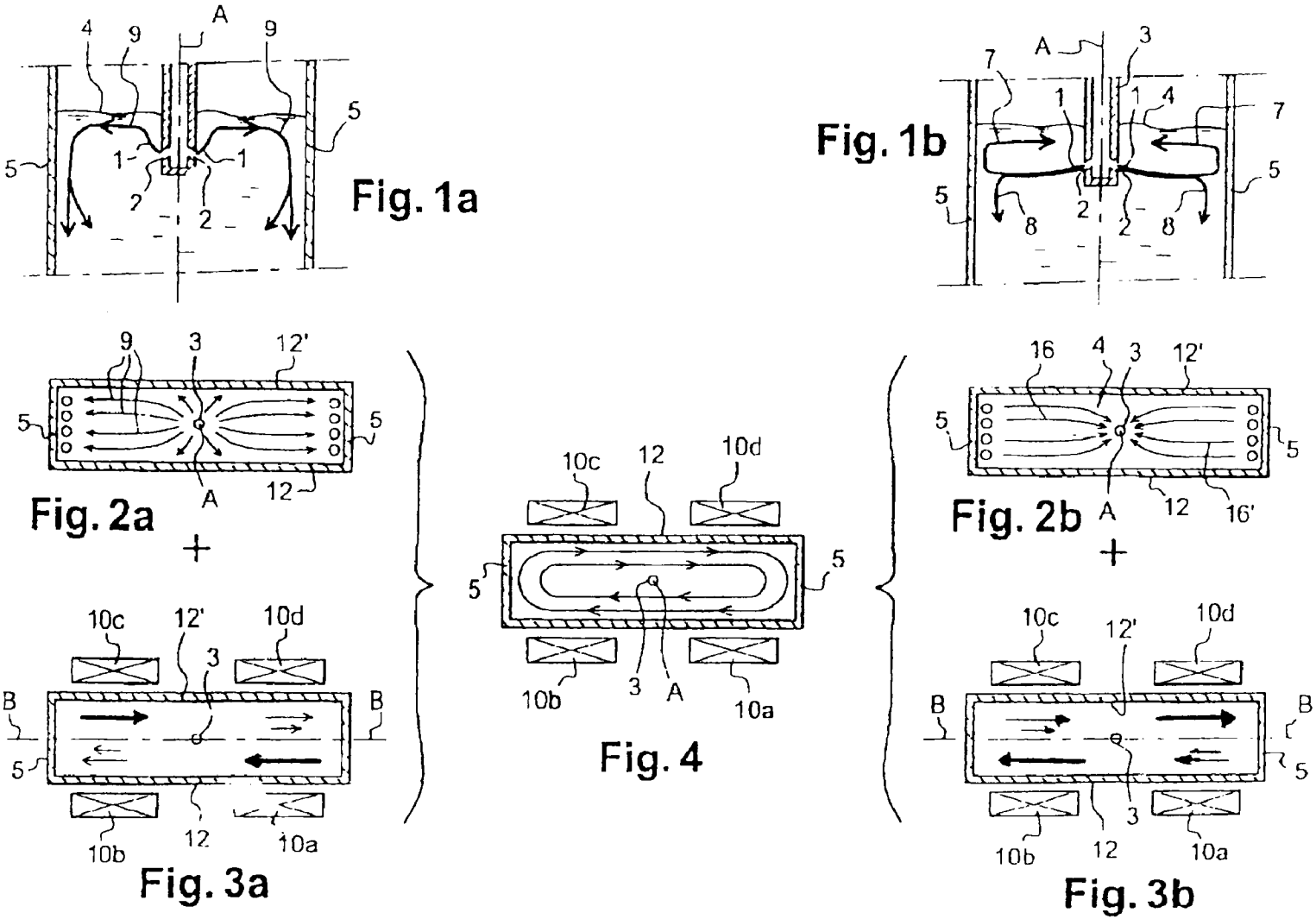
FIGS. 1*a* and 1*b* respectively illustrate a set-up of the "single roll" type and a set-up of the "double roll" type, as they develop during casting within the continuous casting ingot mould for slabs in the median B of the principal axis of the ingot mould parallel to its large sides and passing through the casting axis, on which is centred the spout of the casting.
FIGS. 2*a* and 2*b* illustrate in a top view of the ingot mould the movements of circulation of the metal at the meniscus in the case of a natural flow of respectively the "single roll" and "double roll" type of the molten metal in the ingot mould.
FIG. 3*a* illustrates a cartographical scheme of the field of electromagnetic driving forces according to the invention at the level of the meniscus to be applied to a natural flow of the molten metal of the "single roll" type of FIG. 2*a;*
FIG. 3*b* illustrates a cartographical scheme of the field of electromagnetic driving forces according to the invention at the level of the meniscus to be applied to a natural flow of the molten metal of the "double roll" type of FIG. 2*b;*
FIG. 4 represents, as seen likewise from above, the homogeneous circulatory movement of the molten metal obtained at the meniscus by the application of the field of driving forces according to FIG. 3*a* to the topology of movements on the surface of the "single roll" type of FIG. 2*a*, or by the application of the field of driving forces according to FIG. 3*b* to the topology of movements on the surface of the "double roll" type of FIG. 2*b;*

Firstly, it should be pointed out the electromagnetic force F, acting on an elementary volume of liquid metal to carry it along in the direction of propagation of the magnetic field creating this force, can be approximated by the equation $F=\sigma V B_{eff}^2$, where $\sigma$ is the electrical conductivity of the metal, $B_{eff}$ is the effective intensity of the magnetic induction and V is the speed relative to the travel of the field with respect to the metal. This relative speed is given by the equation $V=2\tau f$, where $\tau$ is the graded pitch of the inductor (which is the distance between the windings of the inductor), f the frequency of the electric current supplying this inductor and V is the speed of the metal subjected to the field, assumed to be progressing in the same direction as the field. According to Ampere's theory, $B_{eff}$ results directly from the effective intensity $I_{eff}$ of the electric current passing through the conductors of the inductor.

Because as a general rule the graded pitch $\tau$ of the inductor is a constant that depends on the construction, it is evident that the intensity of the driving force F can be controlled either by the intensity $I_{eff}$ of the supplied electric current, or by the frequency f of this current, if a variable frequency electric current is available. Furthermore, if one admits for the purposes of simplification that the driving force is controlled by the intensity of the supplied electrical current, the electricity supply being governed such that its frequency has a low value of 3 Hz or less in order to obtain a sufficient depth of penetration of the magnetic induction in the molten metal in proximity to the inductor, taking into account the wall thickness of the ingot mould to be gone through and the composition of the metal forming the wall.

With a view to clarity, we have tried to describe the implementation of the invention in terms of the driving forces of the liquid metal rather than in terms of the travelling magnetic fields, it being understood that it is these fields that produce these forces by interaction with the metal and that these fields are generated by the inductors whose operation is governed by controlling the electric current (intensity or frequency) that feed them.

In regard to the natural hydrodynamics of a bath of molten metal inside a continuous casting ingot mould for slabs, said ingot being fed with molten metal by a central, submerged pouring spout having lateral outlets, we have demonstrated that these hydrodynamics could occur according to three possible types of circulation, two principal stable modes and one unstable mode.

A first stable mode is the "double roll" mode. In this mode, illustrated by FIGS. 1*b* and 2*b*, each spurt of metal 1 that arrives in the ingot through a lateral outlet 2 of the submerged pouring spout 3 centred on the casting axis A, arrives on a small exterior side 5 of the ingot mould with an incidence and an amount of movement such that it is divided up on impact into two opposing currents 7 and 8. One current 8 goes deep down and one current 7 rises along the small side 5 up to the meniscus 4, where on arriving at this level, develops a swell 16 that progresses along the large sides 12, 12' towards the axis A of the ingot mould, thereby meeting the matching swell 16' coming from the other small side 5'.

A second stable mode is called the "single roll". In this mode, illustrated by the FIGS. 1*a* and 2*a*, the previous conditions concerning the relative strength of the entering spurts 1 are not met. The buoyancy of the gas bubbles dispersed in the current of metal, originating from the argon injected into the spout, is now preponderant: soon after leaving the outlets 2 of the spout, a current 9, arriving from the quasi totality of the spurt of metal 1, rises towards the meniscus 4, which thus becomes the font of a circulation of molten metal that progresses from the spout 3 towards each of the small sides 5 and 5', where, on arrival, the surface current plunges towards the floor of the ingot mould.

As needed, one can find a detailed description of these two types of flow of metal in the article by Pierre H. Dauby et al., presented at the 4$^{th}$ European Continuous Casting Congress held at Birmingham (GB) on the 14, 15 and 16 Oct. 2002 and entitled "*On the effect of liquid steel flow pattern on slab quality and the need for dynamic electromagnetic control in the mold*", the contents of which being incorporated in the present document for reference.

These two principal modes are completed by a mode that is not presented, because happily less frequent, which expresses instabilities, generally transient, but not always, of the flows inside the ingot mould. It is known that one cause is due to the fact that during casting, a casting parameter is changed, either intentionally (changes in dimensions during casting, for example) or fortuitously (argon flow rate for example). That can suffice for a transition between a "single roll" flow and a "double roll" flow, and vice versa, to be imposed on the circulation of the metal, without one being able to do anything to prevent it, or even knowing about it. Another cause can be the result of a dissymmetry in the exiting spurts due to the appearance, for example of a partial blockage of a lateral outlet of the spout. Still another reason, in fact perhaps the most frequent, can be an unfavourable combination of the values of the four essential parameters that govern the casting (width of the slab, rate of casting, argon flow rate and immersion depth of the outlets of the spout) which then generate chaotic hydrodynamic phenomena that lead to complex and random spatial energy distributions which can result in a permanent oscillation between a "single roll" flow and a "double roll" flow, and vice versa. In fact, it is difficult to describe this third mode in a simple manner, other than by mentioning the phenomena of "left-right" swings of the mass of molten metal in the ingot mould on either side of the spout thereby causing rolling and pitching at the level of the meniscus, which can even affect the success of the casting, should they persist for too long. This mode will be identified as an "unstable flow" if the measurement of the speed of the metal at the meniscus, taken for example about half way between the spout and a small side, fluctuates and gives on average a zero value.

Bearing this in mind, the meaning of "homogenous" should also be defined when the term is used to qualify the axial rotational movement of the molten metal at the meniscus, as well as the metallurgical interest of such an axial rotation as depicted as an illustration in FIG. 4. A homogeneous axial rotational movement of the molten metal at the meniscus is defined as such when the speeds along the walls are all equal (or essentially equal) at all points of the meniscus. If not, as the molten metal is an incompressible liquid, then sporadic and uncontrollable mini circuits of recirculation will inevitably be formed, which can degenerate into local vortices that, as is well known, are extremely detrimental to the metallurgical purity of the cast metal.

Having said that, the interest per se for an axial rotation of the metal at the meniscus results in fact from the two major functions associated with this circular movement.

A first function is that of "stirring" the bath of metal resulting in a thermal homogenisation at the meniscus. If not, local temperature gradients are created there and irreparably lead to heterogeneities of solidification of the first skin in contact with the cooled copper wall of the ingot mould, and consequently, as is known, the appearance of cracks in the product during solidification and the associated risks of breakthroughs.

A second function is the "washing" of the solidification front. Gas bubbles or non-metallic particles which are inevitably present in molten metal are often found trapped in cavities at the solidification front undergoing dendritic growth and become what are commonly known as inclusions. If the speed of the sweeping current exceeds a threshold value, specific to each case, the gas bubbles and particles are released and entrained with the current of metal until they are decanted at the surface where they are trapped by the covering layer of floating slag. Consequently, the skin of the cast, solidified product is exempt of inclusions and the quality of the resulting product is good.

It should be noted that this washing of the emerging front by a current of metal sweeping across it horizontally also contributes to the temperature homogeneity of the free surface of the molten metal by harmonising the speeds. As already underlined, molten steel being a liquid and therefore in an incompressible physical state, all heterogeneities in the speed at the surface can be the cause of sporadic appearances of local vortices that are at the origin of contamination of the metal by entraining powder from the covering layer deep into the metallic bath.

Having concluded these comments, let us now initially consider the scenario when the circulation of the metallic bath is in the "single roll" mode.

The diagram, as seen from above the ingot mould, of the natural circulating movements of the metal generated at the meniscus is illustrated in FIG. 2*a*. As can be seen, we are dealing, so to speak, with two conflicting straw broom heads developing on either side of the spout 3, and whose emerging strands 1, still bunched together around the spout (the exiting spurts 1), diverge rapidly and spread out in a bundle of parallel strands 9 progressing as far as the proximity of the small sides 5 where they then bend towards the bottom to plunge into the depths of the ingot mould (cf. FIG. 1*a*).

Let us now look at the matching FIG. 3*a*, which illustrates an embodiment of the invention, adapted to the "single roll" case. The ingot mould is an elongated rectangular cross-section defining the dimensions of the cast slab. The submerged pouring spout 3 is centred on the casting axis A. Four flat polyphase inductors (in this example, three phase) 10*a*, 10*b*, 10*c* and 10*d*, for a travelling magnetic field determined by the width of the ingot mould, are mounted facing the large sides 12 and 12' of the ingot mould with two inductors per large side. The inductors 10*a* and 10*b* are mounted and aligned on the large side 12 either side of the spout 3, and the inductors 10*c* and 10*d* are similarly on the large side 12'. These four inductors form a symmetrical set in the geometry of the ingot mould, both in the axial symmetry in respect to the casting axis A and in the planar symmetry in respect to the major median plane B of the ingot mould parallel to the large sides 12, 12' and passing through the casting axis A. Thus, for example, the inductor 10*a* is both the symmetric of the inductor 10*d* placed opposite with respect to the major median plane B, the symmetric of the inductor 10*b* placed side by side with respect to the secondary median plane (not shown) and the symmetric of the inductor 10*c* placed diagonally with respect to the casting axis 3 (itself located at the intersection of the major median plane B and the secondary median plane).

As can be seen, this layout is such that each inductor covers about one half of the width of the large side 12, 12' on which it is centred. This covering can be only partial as it is not necessary for the magnetic field to act up to the level of the small end sides 5, 5', nor at the level of the spout 3, either. On the contrary, it can be useful to conserve an empty space of some centimetres between two juxtaposed inductors so as to allow a mechanical reinforcement of the structure of the ingot mould to be located there.

The inductors are connected to the electrical power supply such that the inductors located side by side on a same large side of the ingot mould produce magnetic fields that travel in the same direction as one another and in the opposite direction to that of the magnetic fields produced by the two inductors located opposite on the other large side. In the presence of molten metal in the ingot mould, there results a system of four driving forces, each associated to a distinct inductor:

- a first pair of forces, diagonally opposite one another on each large side 12 and 12' (the forces associated to the inductors 10*a* and 10*c*), pushing the metal from the small sides 5 and 5' towards the casting axis 3, and called, for the sake of simplicity, forces pushing "towards the interior";
- and a second pair of forces, opposite one another on the other diagonal (the forces associated to the inductors 10*b* and 10*d*), pushing the metal from the casting axis 3 towards the small sides 5 and 5' and called forces pushing "towards the exterior".

For reasons of clarity, these forces are shown by vectors positioned inside the ingot mould near to the large walls, along the inductors in question.

In accordance with an essential characteristic of the invention, the driving forces for the liquid metal produced by two inductors side by side facing a large side of the ingot mould are of different intensities.

Applied in the present case with a circulation of metal of the "single roll" type within the ingot mould, this characteristic means, as is shown in FIG. 3*a*, that the diagonal pair of forces pushing "towards the interior" (bold arrows) is of higher intensity than that of the other diagonal pair that pushes "towards the exterior" (normal arrows).

In fact, the inductors 10*a* and 10*c* acting "against the current" of the natural flow at the meniscus (cf. FIG. 2*a*), have to produce an driving force greater than that of their neighbouring inductor, 10*b* and 10*d* respectively, which themselves act "with the current" of the natural flow at the meniscus. This, as will be understood, in order to try to obtain a forced flow at a speed essentially identical in intensity at all points of the width of the ingot mould near the large sides. If the forces of two inductors side by side on a large side were equal, that pushing "towards the interior" and therefore having to overcome the counter current of the natural flow on half the width in question, would produce a flow inevitably weaker than on the other half width next to it, which would lead to a heterogeneous global flow.

Consequently, one can understand that, in accordance with the invention, the use of the combination of pairs of driving forces illustrated in FIG. 3*a* (the forces 10*a*, 10*c* push stronger than the forces 10*b*, 10*d*) lends to the molten metal at the meniscus an overall movement that goes from the natural configuration shown in FIG. 2*a* to a stable and well formed oblong gyratory configuration about the casting axis, as is illustrated in FIG. 4.

As already underlined, it is the intensity of the electric currents powering the inductors that is the main factor in actively managing the intensity of the forces and hence their difference between pairs pushing "towards the interior" and pairs pushing "towards the exterior" in order to implement the invention. Accordingly, this difference will be the greater the more heterogeneous the circulation of the metal along the large walls so as to enable a better equalisation of the speeds of the moving metal opposite each inductor, and more the axial, oblong rotational movement of the metal at the meniscus will be homogeneous and well developed at the surface of the meniscus. The optimum control setting will obviously vary with the specific characteristics of each cast. This can be achieved, or to a close approximation, for example by installing instruments to directly measure the local speed at the meniscus, at either side of the spout, to control the driving forces, or by predictive management, and will be described further below with reference to FIGS. 5 and 6.

An analogous result in regard to the stable and homogeneous nature of the rotational movement of the metal at the meniscus will also be obtained in the case where the natural mode of circulation of the metallic bath in the ingot mould is of the "double roll" type (cf. FIG. 2*b*).

In regard to this effect, FIG. 3*b* demonstrates that the opposite arrangement to that of FIG. 3*a* prevails: it is the pair of forces 10*b*, 10*d* pushing "towards the exterior" which is this time more energised with respect to the pair 10*a*, 10*c* pushing "towards the interior". In this arrangement, the application of such a set of pairs of differentiated forces has the effect of lending the molten metal at the meniscus an overall movement that changes over from the natural configuration of FIG. 2*b* to a stable and homogeneous, oblong configuration about the casting axis A, as is illustrated in FIG. 4.

On the other hand, in the case of an "unstable flow", the difference between the intensities of the forces pushing "towards the interior" and the forces pushing "towards the exterior" will preferably be set to zero, and the intensities increased until an axial rotational movement at the meniscus is obtained which is as homogeneous as possible.

Now, referring to the FIGS. 5 and 6, the design of electromagnetic equipment in accordance with the invention will be described in more practical terms for two variants of embodiment, as well as the electrical connections between the four inductors and with their polyphase power supply unit. The equipment is shown assembled and ready to function on an ingot mould for casting slabs, where only the single submerged pouring spout 3 centred on the casting axis A, the large sides 12, 12' and the small end sides 5, 5' have been depicted so as not to needlessly overload the Figure.

In the example under consideration, the two inductors placed diagonally to one another are connected to the same power supply. Thus, the inductors 10*a* and 10*c* are connected to the power supply 15*a* and the inductors 10*b* and 10*d* are connected to the power supply 15*b*.

Of course, the order of the polarities to be respected is that which will ensure the travel of the magnetic fields in the required direction. Accordingly, in the embodied assembly, the inductors produce the respective magnetic fields that travel horizontally as depicted in FIGS. 3*a* and 3*b* in order to lend a gyratory movement to the metal at the meniscus, which, as seen from above, develops in the clockwise direction as shown in FIG. 4. It can be readily understood that if for any reason an anticlockwise movement at the meniscus were required, then it would suffice to inverse the polarities of the inductors.

The power supply unit is composed of two distinct identical power supplies 15*a* and 15*b* each equipped with means to differentiate the intensities of the driving forces per pair of inductors. Each pair of inductors positioned diagonally and matched in this way is connected to one and to only one power supply: the pair 10*a*, 10*c* being powered by the power supply 15*a* and the pair 10*b*, 10*d* by the power supply 15*b*. It should be noted that the power supplies are polyphased, preferably two phase or three phase, in order that the inductors can produce a travelling magnetic field. As already mentioned, variable frequency transistor power supplies of the type VVVF (variable voltage variable frequency) are preferred so as to be able to easily control the electrical current intensity, thus the intensity of the magnetic field, and its frequency, thus the displacement rate of the travelling fields.

If the natural circulation of the metallic bath is of the "single roll" type, then the power supplies are adjusted such that the power supply 15*a*, by the selected current intensity (and likewise its frequency, if need be) is able to produce at the two diagonally placed inductors 10*a* and 10*c* that it feeds, an driving force of the metal that is greater than that produced by the two other diagonally placed inductors 10*b* and 10*d* connected to the power supply 15*b*. And conversely, if the natural circulation of the bath is of the "double roll" type. In the case of an "unstable flow", the two power supplies 15*a* and 15*b* are adjusted so as to make the four inductors deliver the same current intensity.

The two variants of the embodiment of the equipment according to the invention differ in the control mode of these electric power supplies.

Figure 5:
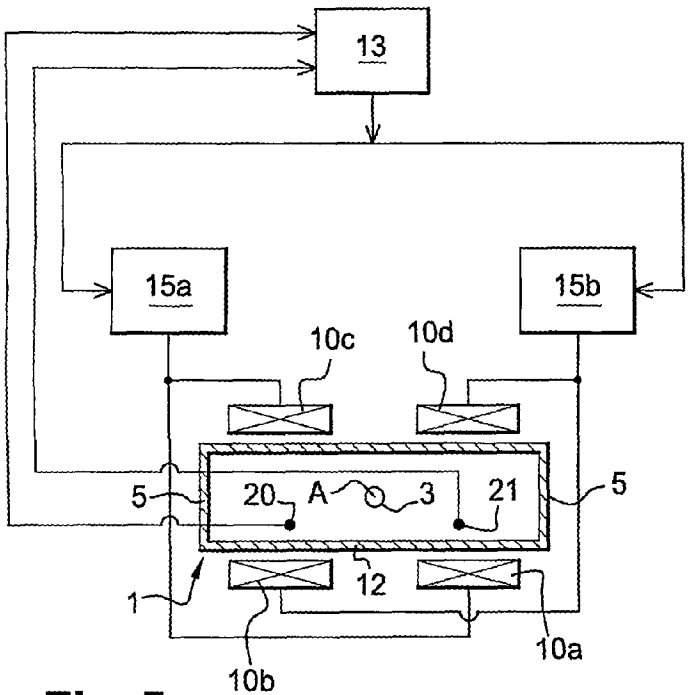
FIG. 5 is a diagram of equipment according to the invention in its control version by measurement, of the nature of the flow of molten metal at the meniscus of a continuous casting ingot mould for steel slabs so as to realise the homogeneous axial rotational movement of the molten metal of FIG. 4.

According to a first variant, depicted in FIG. 5 and based on a direct measurement of the speeds at the meniscus, the electric power supplies 15*a* and 15*b* are controlled according to the abovementioned criteria by means of a regulator 13. Its function is to permanently regulate the difference in intensity of the currents to be applied between the pair of inductors that has to create the greatest pushing force and the other pair, as a function of the speeds at the meniscus, which it receives from the measuring means of the speed of the fluids.

These measuring means are made up of two speed-measuring probes 20 and 21. These probes are slightly immersed in the molten metal at separate locations of the meniscus on either side of the spout 3, preferably equidistant from it and also at the same distance from a same large wall of the ingot mould, here the large wall 12. They can be mechanical probes in which a torsion torque is formed by a pulse from the metallic current, which therefore directly depends on the speed of the flowing metal. These velocity sensors transmit their data to the regulator 13 in the form of carrier signals of a sign indicating the direction of the measured speed.

The regulator 13 that receives these signals of velocity, in fact the algebraic difference so as to work out a set point signal proportional to the difference in velocities and whose sign provides information on which of the two metallic currents in contact with the probes 20 and 21 on either side of the spout is the strongest, and therefore which of the two pairs of inductors should generate the lowest pushing force. This set point will enable the power supplies 15*a*, 15*b* to supply adequate current intensities to the inductors, i.e. differentiated intensities with a difference between them, which will be expressed by the differentiated pushing forces, whose effect on the metal will cause the set point signal to tend to zero, ensuring the required homogeneity of the rotational movement of the metal at the meniscus.

If the signals of velocity from the two probes start to fluctuate about zero, then the movement of the molten metal at the meniscus is unstable and the difference in the current intensities to be applied between the two pairs of inductors will be set to zero.

Of course, such a control loop for the driving forces on the speeds at the meniscus presumes a start-up phase.

At the beginning of the casting, the four driving forces will be equal in intensity. In practical terms, the pushing forces "towards the interior" (inductors 10*a*, 10*c*), like the pushing forces "towards the exterior" (inductors 10*b*, 10*d*) can be produced, for example, with a current of 500 A per inductor.

Subsequently, the regulator 13 carries out a first measurement of the speeds of the metallic currents by the probes 20 and 21 located near to the wall 12 facing the inductors 10*b* and 10*a* respectively and works out a signal reflecting their difference. It can be grasped that this differential signal, both in amplitude and sign, will depend on the type of natural flow of the metal in the ingot mould. If need be, FIGS. 2*a* and 2*b* can be consulted to note in fact that if the flow type is in "single roll" mode (FIG. 2*a*) then the probe 20 will measure a speed distinctly higher than that measured by probe 21, and inversely if the flow is in "double roll" mode (FIG. 2*b*). The sign of this differential signal will therefore inform the regulator 13 on the identity of the type of flow, and its amplitude will enable it to work out the signal of the intensity difference for driving the power supplies 15*a*, 15*b*. Then the command loop for the forces can initiate and take over for the main period of casting, whatever the changes in the mode of natural flow of the bath in the ingot mould.

Stated in a more general way, the instruction for current intensity (and for frequency) is preselected and applied to the four inductors at the start-up of the rotation of the metal, prior to the control phase per se. This preselection is made either manually, or automatically according to the saved values, for example in a programmable controller, as a function of the details of the cast metal and/or the required quality objectives. A programmable controller of this type (e.g. a PLC) could contain the regulator 13.

Figure 6:
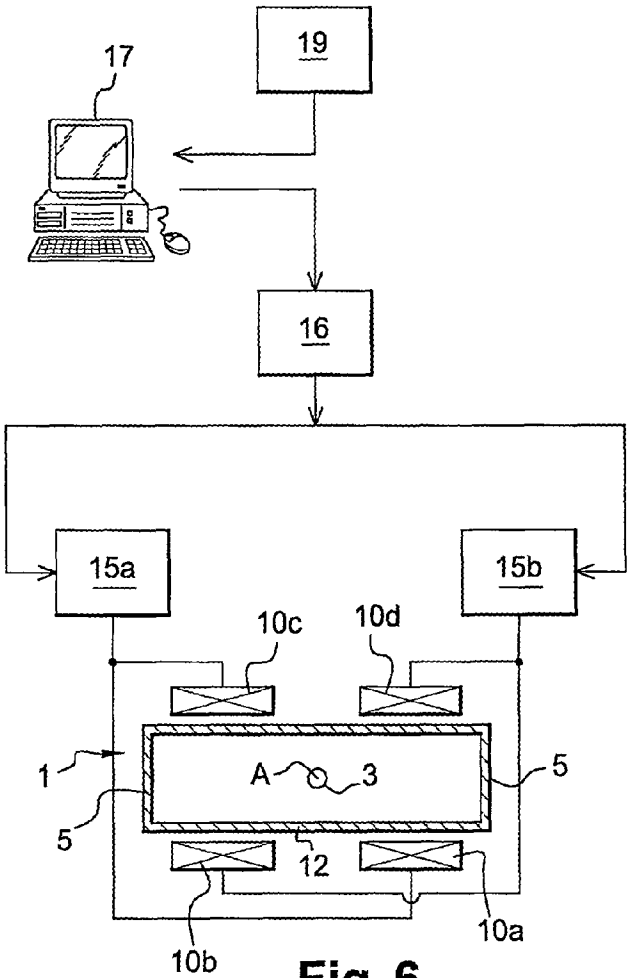
FIG. 6 is a diagram of equipment according to the invention in its control version by prediction, of the nature of the flow of molten metal inside a continuous casting ingot mould for steel slabs so as to realise the homogeneous axial rotational movement of the molten metal of FIG. 4 at the meniscus.

The second variant of the embodiment of the equipment, depicted in FIG. 6, is based on a predictive approach of the natural flows of the molten metal. The control of the power supplies 15*a* and 15*b* according to the previously mentioned criteria occurs with the help of the control means 16. These advantageously comprise a programmable controller of the commercially available PLC type (PLC=Programmable Logic Controller), whose function is to calculate and impose the set point values for current intensity (and when needed also frequency) on the power supplies 15*a* and 15*b* separately. The PLC 16 is therefore in this case the system that will determine which of the pairs of inductors will have to create the highest pushing force, but this time in response to the predictive identification of the type of natural flow of the metallic bath in the ingot mould, and not by regulation to cancel a signal of difference coming from a direct measurement of the speeds at the meniscus.

In addition, the PLC 16 receives data that it requires for this task by the means 17 of identification of the mode of flow of the metallic bath in the ingot mold.

It should be noted that these means of identification therefore replace the velocity sensors of the first variant of the embodiment, as these, as will be explained below, are not very easy to use in a continuous casting ingot mould.

These means of identification 17 include a standard computer, like a PC (personal computer) with a random access memory that comprises the necessary tools for this identification.

It is worth pointing out here that the term "identification of the mode of flow" is understood to mean not only the qualitative prediction of whether a flow is of the type "single" or "double roll" or "unstable", but also the quantitative prediction of the speed of flow of the metal at the meniscus, it being understood that a speed predicted to be zero is assimilated as an unstable state.

Basically, therefore, these tools consist of appropriate software, constructed on a mathematical model of fluid mechanics capable of predicting the mode of flow of the bath in the ingot mould starting from, firstly, two initially fixed parameters of casting, which are the thickness of the ingot mould and the geometry of the spout and, secondly, the four values subject to variation during casting, which are the width of the cast slab, the speed of casting, the immersion depth of the openings of the spout and the flow rate of the injected argon. All these data, the fixed doublet like the variable quadruplet, are preferably input by automatic data capture from the general computer 19 of the casting installation and managing the casting operations. For a rapid identification of the mode of flow, the results produced by this software can be put in concrete form in the form of tables that the PLC can use by automatic capture or after their transcription in an analytical form.

It can also be a data bank that associates all the possible value of the sets of "doublets-quadruplets" of quantities with the mode of flow that each of them underlies. During the casting, the regular comparison over time of an instantaneous set "doublet-quadruplet" specific to the casting with those of this data bank enables the memorised element to be retained that best corresponds to the data of the casting and consequently identify, qualitatively and quantitatively, the mode of natural flow of the molten metal inside the ingot mould.

Finally, for each mode of flow calculated in this way, the results given by the PC 17 will be capable of course of furnishing a computed value of the natural average speed of the metal at the meniscus, this value permits the control PLC 16 to determine a difference value, for example 200 A (i.e. 600 A for the two most active and 400 A for the two others when the initial current at start-up had been preselected at 500 A) and to instruct in this way the electric power supplies 15*a* and 15*b* to supply the corresponding current intensities to the pairs of inductors in question.

In summary, the means of identification 17 provide to the control means 16 a signal whose amplitude is proportional to the speed of natural flow of the molten metal at the meniscus and whose sign (depending on the whether the direction of this speed is towards the interior or the exterior) provides information on the identity of the type of flow as "single roll" or "double roll". The controller 16 then determines which of the two pairs of inductors must create the greatest pushing force according to the prevailing type of flow. It also calculates the difference in intensity of the supply currents between the two pairs of inductors in question, such that this difference is proportional to the average speed of the metal at the meniscus and transmits the corresponding commands to the electric power supplies 15*a* and 15*b*.

If the PLC 16 receives from PC 17 a signal of null amplitude, it cancels the difference in the supply currents (and frequencies) and gives the same command for supply current (and frequency) to the four inductors, command corresponding to the preselected or saved value dependent on the details of the cast metal and/or the required quality objectives.

One can easily understand that the invention provides an "in-line" homogenisation of the axial rotation at the meniscus during casting. The automatic data capture of the quadruplet of variable parameters that characterise the mode of flow permits at each moment, in response to the values of these quadruplets arriving at the PC 17, and as long as the casting continues, the application of an adequate differentiation of the pushing forces of the inductors that will permanently ensure a homogeneous rotation of the meniscus, irrespective of the modes of flow that could follow each other inside the ingot mould during casting. In contrast therefore to the systems of the prior art which are adapted for one mode of flow and only one, therefore suited for a casting sequence that is only a fraction of the time of the total casting, the invention ensures an optimal active "coverage" of the casting for the totality of its duration, or its quasi-totality, bearing in mind the possible sequences of unstable flow.

The choice between a "control" system and a "predictive" system is left to the appreciation of the user, who will choose in accordance with his requirements or needs. We simply note here that the variant of the "predictive" embodiment certainly seems to require rather more software, but on the other hand it offers advantages, often crucial, in that it leaves the meniscus exempt from immersed instruments and does not require velocity sensors that have a limited working life of several hours at best.

Obviously, the invention should not be limited to the examples that have just been described, but should extend to a plurality of variants and equivalents, in so far as they are as defined by the claims presented below.

Accordingly, the inductors that form a pair connected to a given electric power supply, 15*a* or 15*b*, can be electrically connected to one other in parallel as depicted in FIGS. 5 and 6, or in series.

Similarly, as many electrical power supplies as inductors can be provided. Each one of them can be supplied with current by its own dedicated power supply, this will principally allow an increased flexibility to the controls by permitting, if needed, disequilibria in the intensities of the forces produced by the diagonally positioned inductors.

In fact, if it seems more rational that the driving forces of two diagonally positioned inductors be equal, then this is not therefore an obligatory part of the invention. Indeed, these forces can differ between themselves in intensity if it were considered preferable to proceed in such a way as to satisfy the primary criterion of obtaining a homogeneous rotation at the meniscus, i.e. equal speeds of the molten metal in front of each inductor.

Likewise, the number of inductors can be greater than four, bearing in mind that this number has to be even in order to equip each large side of the ingot mould with the same number of inductors.

Furthermore, in regard to the possible question of the height at which the inductors should be mounted on the ingot mould, there is in principle no obligation to raise them up to the level of the meniscus. If the inductors are designed for an adequate electric power, i.e. for a sufficient force, the inductors can be positioned even at several tens of centimetres below the meniscus, and still be able to provide a sufficiently stable and homogeneous rotational movement to the meniscus.

The invention claimed is:

1. A method for bringing about axial electromagnetic rotation of molten metal in an ingot mold for continuous casting of slabs, the mold provided with an immersed casting spout having lateral outlet louvers open toward small end faces of the ingot mold, the method comprising:

identifying a natural flow mode of the molten metal as one of single loop, double loop, and unstable mode;

mounting at least four separate polyphase inductors with magnetic fields sliding along the width of the ingot mold on large faces of the ingot mold in a proportion of two inductors per large face;

controlling the inductors to create a system of four driving forces, whose two forces associated with a pair of inductors situated diagonally relative to a casting axis push the metal from the nozzle toward the small faces and therefore toward the exterior, while the other two forces, themselves associated with the other pair of diagonally disposed inductors, push the metal from the small faces toward a nozzle and therefore toward the interior;

imposing an axial rotational motion of the molten metal at a meniscus with the forces;

intensifying the forces pushing the metal toward the interior more greatly if the natural flow mode is the single loop mode, intensifying the forces pushing the metal toward the exterior more greatly if the natural flow mode of the metal is the double loop mode, and controlling the forces to be a same intensity if the natural flow mode is the unstable flow mode; and homogenizing rotational motion of the molten metal at the meniscus in a course of casting.

2. The method according to claim 1, further comprising:

controlling the two driving forces associated with the two diagonally disposed inductors to be a same intensity.

* * * * *